US010087558B2

(12) United States Patent
Hatayama et al.

(10) Patent No.: US 10,087,558 B2
(45) Date of Patent: Oct. 2, 2018

(54) CARBON FIBER MANUFACTURING METHOD

(71) Applicant: Mitsubishi Chemical Corporation, Tokyo (JP)

(72) Inventors: Akito Hatayama, Toyohashi (JP); Naoki Sugiura, Toyohashi (JP); Masahiro Hata, Toyohashi (JP)

(73) Assignee: Mitsubishi Chemical Corporation, Tokyo (JP)

( * ) Notice: Subject to any disclaimer, the term of this patent is extended or adjusted under 35 U.S.C. 154(b) by 299 days.

(21) Appl. No.: 14/780,287

(22) PCT Filed: Mar. 26, 2014

(86) PCT No.: PCT/JP2014/058647
§ 371 (c)(1),
(2) Date: Sep. 25, 2015

(87) PCT Pub. No.: WO2014/157394
PCT Pub. Date: Oct. 2, 2014

(65) Prior Publication Data

US 2016/0040322 A1 Feb. 11, 2016

(30) Foreign Application Priority Data

Mar. 27, 2013 (JP) ..... 2013-066096

(51) Int. Cl.
*D01F 9/22* (2006.01)
*D06C 7/04* (2006.01)
(Continued)

(52) U.S. Cl.
CPC ..... *D01F 9/22* (2013.01); *D01F 9/328* (2013.01); *D06C 7/04* (2013.01); *F27B 9/145* (2013.01);
(Continued)

(58) Field of Classification Search
CPC ..... D01F 9/22
See application file for complete search history.

(56) References Cited

U.S. PATENT DOCUMENTS 5,908,290 A 6/1999 Kawamura et al.

FOREIGN PATENT DOCUMENTS

JP 62 228865 10/1987
JP 62-289617 A 12/1987
(Continued)

OTHER PUBLICATIONS

Machine translation of JP 2012153987.*
(Continued)

*Primary Examiner* — Larry Thrower
(74) *Attorney, Agent, or Firm* — Oblon, McClelland, Maier & Neustadt, L.L.P.

(57) ABSTRACT

A carbon fiber manufacturing method with which high quality carbon fibers can be obtained. The carbon fiber manufacturing method includes introducing carbon fiber precursor fiber bundles that have been spread in sheet form into a flameproofing furnace, flameproofing the carbon fiber precursor fiber bundles introduced into the flameproofing furnace in a temperature range of 200° C. to 300° C., introducing the flameproofed fiber bundles obtained from the flameproofing treatment into a carbonization furnace, and carbonizing the flameproofed fiber bundles introduced into the carbonization furnace in a temperature range of 300° C. to 2500° C. The flameproofing furnace includes a heat-treatment chamber and a sealing chamber adjacent thereto and discharges air from the sealing chamber to outside of the flameproofing furnace. The space velocity (SV) (1/h) of hot air blown from the heat-treatment chamber into the sealing chamber satisfies relationship: 80≤SV≤400.

6 Claims, 1 Drawing Sheet

(51) Int. Cl.

| | |
|---|---|
| ***F27B 9/28*** | (2006.01) |
| ***D01F 9/32*** | (2006.01) |
| ***F27B 9/14*** | (2006.01) |
| ***F27D 7/04*** | (2006.01) |
| ***F27D 99/00*** | (2010.01) |

(52) U.S. Cl.
CPC ..... *F27B 9/28* (2013.01); *F27D 7/04* (2013.01); *F27D 99/0073* (2013.01)

(56) References Cited

FOREIGN PATENT DOCUMENTS

| | | |
|---|---|---|
| JP | 1-116624 A | 5/1989 |
| JP | 7 118933 | 5/1995 |
| JP | 10-237723 A | 9/1998 |
| JP | 11 173761 | 7/1999 |
| JP | 2000 136441 | 5/2000 |
| JP | 2004 143647 | 5/2004 |
| JP | 2007-132657 A | 5/2007 |
| JP | 2007-284842 A | 11/2007 |
| JP | 2010 223471 | 10/2010 |
| JP | 2011-6804 A | 1/2011 |
| JP | 2012-153987 A | 8/2012 |

OTHER PUBLICATIONS

International Search Report dated Jun. 24, 2014 in PCT/JP14/058647 Filed Mar. 26, 2014.
Notice of Allowance dated Sep. 20, 2016 in Japanese Patent Application No. 2015-146992 (with English language translation).
Extended European Search Report dated Feb. 5, 2016 in Patent Application No. 14773477.6.
Office Action dated Jun. 12, 2018, in European patent application No. 14773477.6 (7 pages).

* cited by examiner

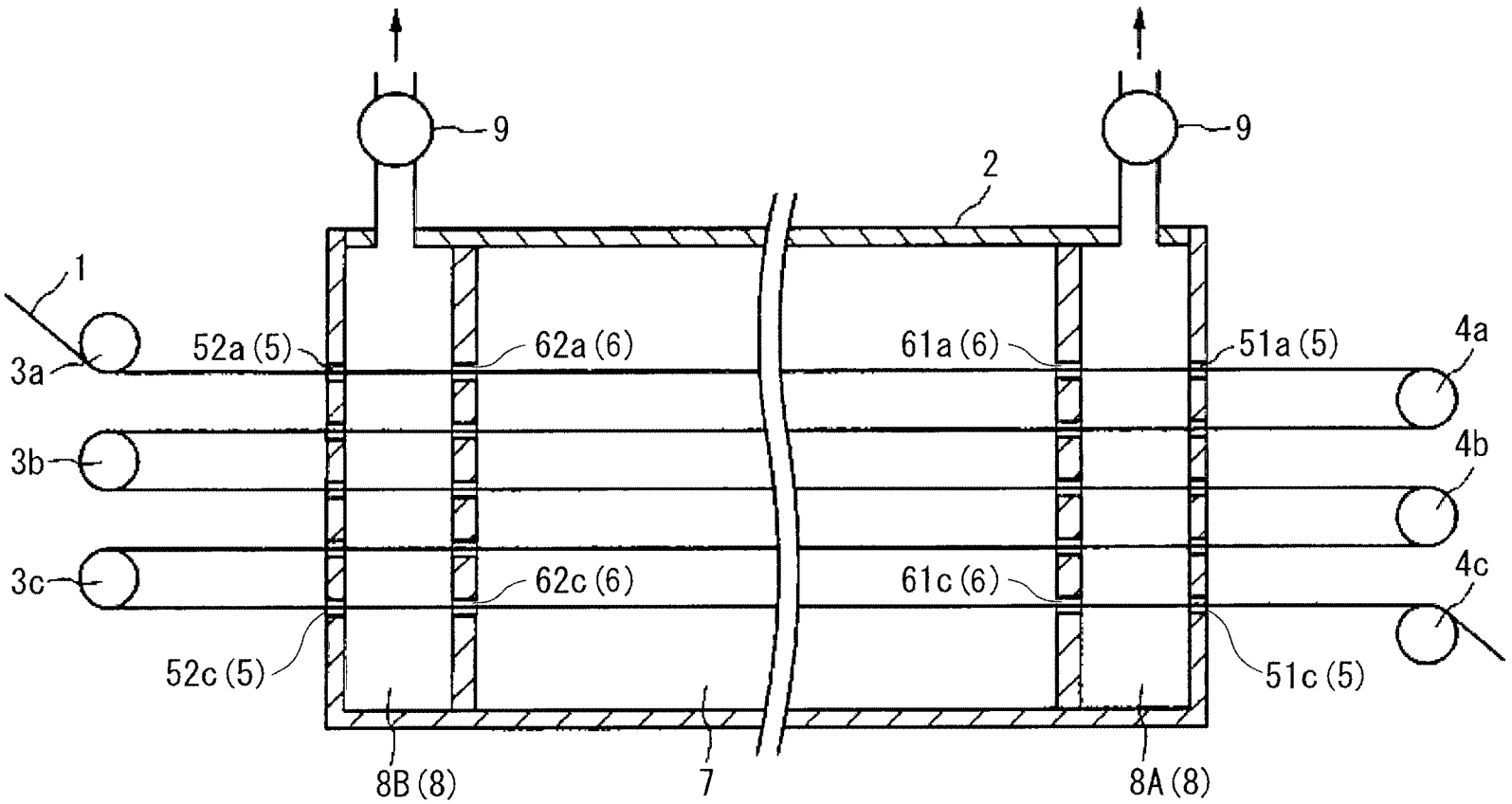
4a
4b
4c
51a (5)
51c (5)
9
8A (8)
2
61a (6)
61c (6)
7
62a (6)
62c (6)
9
8B (8)
52a (5)
52c (5)
1
3a
3b
3c

CARBON FIBER MANUFACTURING METHOD

TECHNICAL FIELD

The present invention relates to a method for manufacturing a carbon fiber.

The present application claims priority of Japanese Patent Application No. 2013-066096, filed in Japan on Mar. 27, 2013, and the contents of which are incorporated herein by reference.

BACKGROUND ART

Manufacture of a carbon fiber is performed by the following method, for example. Specifically, a carbon fiber precursor fiber bundle, for example, a polyacrylonitrile-based fiber bundle is transported in a multi-level manner through the inside of a heat-treatment chamber of a flameproofing furnace by folding back with rollers, heated by hot air at 200° C. to 300° C. to produce a flameproofed fiber having a desired density, before the flameproofed fiber is subjected to a carbonization treatment in a temperature range of 300° C. to 2500° C. in inert gas.

During the flameproofing, gases containing toxic materials are generated from a carbon fiber precursor fiber bundle. In order to prevent leakage of such gases from the flameproofing furnace to atmosphere, a method of forming a sealing chamber adjacent to the flameproofing furnace and lowering the pressure inside the sealing chamber compared to atmospheric pressure is known (for example, Patent Documents 1 to 4).

However, in the gases that are generated from a carbon fiber precursor fiber bundle during the flameproofing, a substance being gaseous in the heat-treatment chamber but aggregating at a lower temperature is included. In general, the temperature inside a sealing chamber is lower than the temperature inside the heat-treatment chamber. Accordingly, there would be a case in which such a substance aggregates inside the sealing chamber and adheres to a carbon fiber precursor fiber bundle. In such a case, there is a possibility of lowering strength of a carbon fiber produced by the following carbonization treatment. According to the inventions described in Patent Documents 1 to 4, such possibility is not necessarily fully considered.

CITATION LIST

Patent Document

Patent Document 1: JP 62-228865 A
Patent Document 2: JP 11-173761 A
Patent Document 3: JP 2000-136441 A
Patent Document 4: JP 2004-143647 A

DISCLOSURE OF THE INVENTION

Problem to be Solved by the Invention

The present invention is devised in order to solve the problems described above, and is to provide a manufacturing method by which a carbon fiber with high quality can be obtained.

Means for Solving Problem

The present invention includes the following embodiments.

(I) A method for manufacturing a carbon fiber satisfying all of (1) to (3) below.

(1) The method includes a step of introducing carbon fiber precursor fiber bundles that have been spread in sheet form into a flameproofing furnace, flameproofing the carbon fiber precursor fiber bundles introduced into the flameproofing furnace in a temperature range of 200° C. to 300° C., introducing the flameproofed fiber bundles obtained from the flameproofing treatment into a carbonization furnace, and carbonizing the flameproofed fiber bundles introduced into the carbonization furnace in a temperature range of 300° C. to 2500° C.

(2) The flameproofing furnace has a heat-treatment chamber and a sealing chamber adjacent thereto and discharges air from the sealing chamber to the outside of the flameproofing furnace.

(3) The space velocity (SV) (1/h) of the hot air blown from the heat-treatment chamber into the sealing chamber satisfies the following relationship: $80 \leq SV \leq 400$.

(II) The method for manufacturing a carbon fiber described in (I), which satisfies (4) below.

(4) When the introduction amount of carbon fiber precursor fiber bundles into the flameproofing furnace is designated as Y (kg/h) and the total air discharge amount from the heat-treatment chamber to the outside of the heat-treatment chamber is designated as X ($Nm^3/h$), the following relationship is satisfied: $0.001 \leq Y/X \leq 0.012$.

(III) The method for manufacturing a carbon fiber according to (I) or (II), which satisfies (5) and (6) below.

(5) The flameproofing is performed by transporting the carbon fiber precursor fiber bundles, in the fiber direction of the carbon fiber precursor fiber bundles, through the inside of the heat-treatment chamber, in which the transport is made such that the carbon fiber precursor fiber bundles are transported in parallel relationship at plural points inside the heat-treatment chamber.

(6) The sealing chamber has outer slits being open on the outer side of the flameproofing furnace and inner slits being open on the heat-treatment chamber, wherein the number of the outer slits and the number of the inner slits are the same as the number of how many times the carbon fiber precursor fiber bundles are transported.

(IV) The method for manufacturing a carbon fiber described in (III), which satisfies (7) and (8) below.

(7) The flameproofing is performed in such a manner that the transport is made in the horizontal direction in the heat-treatment chamber while the plural points indicate plural points at vertically different positions in the heat-treatment chamber.

(8) Each of the plural outer slits is formed at vertically different positions and the opening area of the outer slit present at the lowermost side in the vertical direction is smaller than the opening area of the outer slit present at the uppermost side.

Furthermore, another mode of the embodiment of the present invention has the following constitution.

(V) A method for manufacturing a carbon fiber satisfying (1A) to (3A) below.

(1A) Carbon fiber precursor fiber bundles that have been spread in sheet form is introduced into a flameproofing furnace and subjected to flameproofing in a temperature range of 200° C. to 300° C.; and the obtained flameproofed fiber bundles is introduced into a carbonization furnace and subjected to carbonization in a temperature range of 300° C. to 2500° C.

(2A) The flameproofing furnace has a heat-treatment chamber and a sealing chamber adjacent thereto and discharges air from the sealing chamber to the outside of the flameproofing furnace to prevent leakage of hot air in the heat-treatment chamber to the atmosphere.

(3A) The space velocity (SV) (1/h) of the hot air blown from the heat-treatment chamber into the sealing chamber satisfies the following relationship: $200 \leq SV \leq 400$.

(VI) The method for manufacturing a carbon fiber described in (V), which satisfies (4A) below.

(4A) When the introduction amount of carbon fiber precursor fiber bundles into the flameproofing furnace is designated as Y (kg/h) and the total air discharge amount from the heat-treatment chamber to the outside of the heat-treatment chamber is designated as X ($Nm^3/h$), the following relationship is satisfied: $0.001 \leq Y/X \leq 0.012$.

(VII) The method for manufacturing a carbon fiber described in (V) or (VI), which satisfies (5A) and (6A) below.

(5A) The flameproofing is performed by transporting, in multi-level, the carbon fiber precursor fiber bundles through the inside of the heat-treatment chamber.

(6A) The sealing chamber has plural outer slits and inner slits according to the number of how many times the carbon fiber precursor fiber bundles are transported, wherein the outer slits are open on the outer side of the flameproofing furnace and the inner slits are open on the heat-treatment chamber.

(VIII) The method for manufacturing a carbon fiber described in (III), which satisfies (7A) and (8A) below.

(7A) The carbon fiber precursor fiber bundle is transported in the horizontal direction through the heat-treatment chamber in multi-level in the vertical direction.

(8A) Regarding the plural outer slits, the opening area of the outer slit present at the lowermost side is smaller than the opening area of the outer slit present at the uppermost side.

Effect of the Invention

According to the method for manufacturing a carbon fiber of the present invention, a carbon fiber with high strength and high quality can be obtained.

BRIEF DESCRIPTION OF DRAWINGS

FIG. 1 is a cross-sectional view schematically illustrating a flameproofing furnace according to an embodiment of the present invention.

MODE(S) FOR CARRYING OUT THE INVENTION

Hereinbelow, embodiments of the present invention are described in detail. Meanwhile, in the embodiments, the "up and down direction" or "vertical direction" indicates a direction which is parallel to the gravity direction, the "horizontal direction" indicates a direction which is vertical to the gravity direction, the "up" indicates a direction which is opposite to the gravity, and the "down" indicates a direction of the gravity. Furthermore, in the embodiments each expression also represents so-called approximately the same direction, that is, each direction within −10 to +10°.

(Carbon Fiber Precursor Bundle)

According to the method for manufacturing a carbon fiber of this embodiment, carbon fiber precursor fiber bundles that have been spread in sheet form is first introduced to a flameproofing furnace and subjected to flameproofing in a temperature range of 200° C. to 300° C. A carbon fiber precursor bundle indicates a bundle that is obtained by collecting fibers of a organic compound which are used as carbon fiber precursor fibers, that is the fibers of the organic compound become carbon fibers by carbonization. A fiber of an organic compound is obtained by, for example, spinning a polymer compound, and a fiber bundle in which 1000 to 80000 filament fibers of 3 to 50 μm in diameter are aggregated as a group can be used. Herein, as a carbon fiber precursor, a precursor fiber such as polyacrylonitrile fiber or rayon fiber can be used. Among those, the polyacrylonitrile fiber allows production of a carbon fiber with high quality.

The sheet form indicates a shape whose length or width are larger compared to thickness of a sheet. The dimension of a sheet, that is, thickness, length, or width, indicates a mean value obtained after measurements at any three or more points. Specifically, the sheet form has a shape which has length and width at least 10 times larger than thickness. More preferably, it is a ribbon shape in which the length is at least 10 times larger than the width (at least 100 times the thickness). As the carbon fiber precursor bundle has sufficiently long length, flameproofing can be performed as shown in FIG. 1 while taking-up and transporting the carbon fiber precursor bundle 1 (subject for heating) using the transporting means 3*a* to 3*c* and 4*a* to 4*c* such as a roller described below. As such, a continuous processing can be achieved. As for the carbon fiber precursor fiber bundles that have been spread in sheet form of this embodiment, the sheet form has a width which is 1000 to 10000 times the thickness, and a length which is 10000 to 300000 times the thickness. The carbon fiber precursor fiber bundles that have been spread in sheet form means, for example, that carbon fiber precursors are collected such that their fiber direction is mainly in the length direction and they are formed such that the length direction is longer than the width direction and the width direction is longer than the thickness direction to yield the sheet form with each dimension satisfying the aforementioned relationship.

When a heating treatment is performed for the carbon fiber precursor fiber bundles, it is preferably performed while hot air is applied to at least any one surface of the sheet of the carbon fiber precursor fiber bundles that have been spread in sheet form, in the thickness direction. The heating treatment is more preferably performed by applying hot air on both surfaces, in the thickness direction, the sheet of the carbon fiber precursor fiber bundles. Due to the exothermic chemical reaction in the flameproofing of the carbon fiber precursor fiber bundles, thermal runaway may occur if one attempts to heat the entire carbon fiber precursor fiber bundles by applying heat to limited area of the carbon fiber precursor fiber bundles. On the other hand, like the present embodiment, when hot air is applied on at least one surface, in the thickness direction, of the carbon fiber precursor fiber bundle that has been spread in sheet form, the treatment can be performed over a large area so that the thermal runaway can be prevented. The hot air may be applied to the carbon fiber precursor fiber bundles that have been spread in sheet form, either in the parallel direction or in the vertical direction. As to how it can be performed, a skilled person in the pertinent art can easily make a determination.

(Flameproofing)

(Configuration of Flameproofing Furnace)

As a flameproofing furnace used for flameproofing, a known one can be used. For example, a flameproofing furnace having a structure disclosed in JP 62-228865 A, JP 11-173761 A, JP 2000-136441 A, or JP 2004-143647 A can be used. With these flameproofing furnaces, the carbon fiber precursor fiber bundles are transported, in the fiber direction, at plural points at vertically different position in the heat-treatment chamber to perform flameproofing. The flameproofing (also referred to as infusibilization or stabilization) means heating of a carbon fiber precursor fiber to cause chemical reactions such as oxidation to generate a structure with lots of cyclic structures such as pyrimidine. By the flameproofing, certain stabilization against fire flame or heat is obtained.

A flameproofing furnace 2 used for this embodiment has a heat-treatment chamber 7 provided with a device for heating the inside and a sealing chamber 8 adjacent thereto, as shown in FIG. 1. As for the sealing chamber 8, at least one chamber is formed adjacent to the heat-treatment chamber 7. In particular, it is preferable that at least one pair of the sealing chambers 8 are formed such that they face to each other while having the heat-treatment chamber 7 between them. According to the example shown in the drawing, sealing chambers 8A and 8B are formed while having the heat-treatment chamber 7 between them.

The heat-treatment chamber 7 is a treatment chamber provided with a heating means for treating a carbon fiber precursor bundle in a temperature range of 200° C. to 300° C. Specifically, the heat-treatment chamber 7 has a heater or the like, and it is constituted such that the internal temperature can be adjusted to the aforementioned temperature range. Furthermore, the heat-treatment chamber 7 may be also provided with a ventilation means for supplying and/or discharging the air to and/or from the heat-treatment chamber 7 (not illustrated). The ventilation means may be also provided, for example, with a ventilation hole formed on the heat-treatment chamber 7 and a fan or a pump installed for supplying and/or discharging air. The ventilation means may be also provided with a measuring means (not illustrated) for measuring the gas either supplied to the heat-treatment chamber 7 or the gas discharged from the chamber. As a measuring means, various gas flow meters can be used, and in this embodiment, a Pitot tube, a hot wire anemometer, or the like can be used.

The sealing chamber 8 has outer slits 5 and inner slits 6. The outer slits 5 are open on the outer side of the flameproofing furnace 2 (toward atmospheric air) and the inner slits 6 (opening) are open toward the heat-treatment chamber 7. In this embodiment, the outer slits 5 are formed in the sealing chamber 8A as shown in FIG. 1, from the outer slit 51*c* formed at the lowermost side, in upward direction in order until the uppermost outer slit 51*a*, as shown in the drawing. According to the example shown in the drawing, the number of the outer slits 5 is 5, and the number of the points for transporting carbon fiber precursor fiber bundles 1, which will be described later, at plural points (number of the levels for transport) is also 5. On the sealing chamber 8, each of the inner slits 6 is formed in parallel to the horizontal direction of the drawing such that it has the same height as corresponding one of the outer slits 5, wherein the height is the distance from the bottom of the sealing chamber 8 in the drawing.

For example, on the sealing chamber 8B, the inner slit 61*c* is formed at the same height as the outer slit 51*c* which is present at the lowermost side, and the inner slit 61*a* is formed at the same height as the outer slit 51*a* which is present at the uppermost side. Furthermore, on the sealing chamber 8B which is formed opposite to the sealing chamber 8A while having the heat-treatment chamber 7 between them, each of the inner slit 6 and the outer slit 5 is formed at the same height as above.

For example, on the sealing chamber 8B, the outer slit 52*c* and the inner slit 62*c* are formed at the same height as the outer slit 51*c*, and the outer slit 52*a* and the inner slit 62*a* are formed at the same height as the outer slit 51*a*.

In other words, the flameproofing furnace 2 has one set of slits consisting of an outer slit 5, an inner slit 6, an inner slit 6, and an outer slit 5 each of which is created such that they communicate with each other in the horizontal direction, and by passing through each slit in order, the carbon fiber precursor fiber bundles 1 can be horizontally transported through the flameproofing furnace 2. In the flameproofing furnace 2, plural sets of slits in the horizontal direction are formed at vertically different positions (there are 5 sets in the example of the drawing).

As for the size of the outer slits 5 and the inner slits 6, the width of the opening (size in the up and down direction in the drawing) is 10 to 50 mm, and the length of the opening (size from the front to inner length direction in the drawing) is 1000 to 10000 mm. Meanwhile, according to the example shown in the drawing, the width of the slit opening can be controlled by using a means for adjusting the vertical position of an upper constituent and a lower constituent of the slit.

The sealing chamber is also provided with a ventilation means 9 for exchanging internal air. The ventilation means 9 is preferably a gas discharge fan or the like. When air exchange of the sealing chamber 8 is performed by using the ventilation means 9 such as a gas discharge fan or the like (hereinbelow, the air exchange is also referred to as gas discharge), the air flow introduced from atmospheric air to the sealing chamber 8 and the flow of hot air blown, via the inner slit 6, from the heat-treatment chamber 7 to the sealing chamber 8 are generated. According to those flows, leakage of the hot air inside the heat-treatment chamber 7 to atmospheric air is prevented. In other words, the heat-treatment chamber 7, the sealing chamber 8, and the ventilation means 9 can be configured such that the leakage of the hot air inside the heat-treatment chamber 7 to atmospheric air is prevented. The air ventilation means 9 is also provided with a measuring means (not illustrated) for measuring the gas discharged from the sealing chamber 8. As a measuring means, various gas flow meters can be used, and in this embodiment, for example, a Pitot tube, a hot wire anemometer, or the like can be used.

For the flameproofing furnace 2, the transporting means 3 and 4 for transporting the carbon fiber precursor fiber bundles 1 are arranged so that they are adjacent to each of the outer slit 5. The transporting means 3 and 4 are a means for transporting the carbon fiber precursor fiber bundles 1 through the heat-treatment chamber 7 such that it is transported from the outer slit 5 on one lateral side of the flameproofing furnace 2 to the outer slit 5 on the other lateral side of the furnace via the inner slit 6. According to this embodiment, each the transporting means 3 and 4 is a roller which enables transporting by turning the direction of the carbon fiber precursor fiber bundles 1 along the circumference of the roller. In the example shown in the drawing, each of the transporting means 4*a*, 4*b* and 4*c* is arranged adjacent to each of the outer slit 5 of the sealing chamber 8A and each of the transporting means 3*a*, 3*b* and 3*c* is formed adjacent to each of the outer slit 5 of the sealing chamber 8B.

(Flameproofing Conditions)

According to this embodiment, the flameproofing of the carbon fiber precursor fiber bundle is performed by transporting the carbon fiber precursor fiber bundle, in the fiber direction of the carbon fiber precursor fiber bundle, through the inside of the heat-treatment chamber. In this embodiment, the carbon fiber precursor fiber bundles 1 are transported, by using the transporting means 3 and 4 as shown in FIG. 1, in parallel inside the heat-treatment chamber 7 while allowing communication between the outer slit 5 and the inner slit 6 that are formed in parallel as described above. As described above, since the length direction of the carbon fiber precursor fiber bundles 1 in sheet form is approximately the same as the fiber direction of the carbon fiber precursor which constitutes each bundle of the carbon fiber precursor fiber bundles 1, the carbon fiber precursor fiber bundles 1 can be transported in the fiber direction.

Furthermore, as plural sets of the outer slit 5 and the inner slit 6 that are formed in parallel are provided at vertically different positions (there are 5 sets in the example shown in the drawing), the transportation is made through the each slit set by the transporting means 3 and 4 (both of which are rounding rollers). In the example shown in the drawing, continuous carbon fiber precursor fiber bundles 1 are folded back by the rollers of the transporting means 3 and 4, and thus they pass through in order from the uppermost slit set, then through the following slit set formed in parallel. As a result, the carbon fiber precursor fiber bundles 1 are transported several times through inside of the heat-treatment chamber 7. Conditions such as transport speed are described below.

In the heat-treatment chamber 7, the carbon fiber precursor fiber bundles 1 are applied with hot air by heating means so that the carbon fiber precursor fiber bundles 1 are heated and subjected to flameproofing. Accordingly, the flameproofing of the carbon fiber precursor fiber bundles 1 is performed, at vertically different plural positions in the heat-treatment chamber 7, by transporting them in the horizontal direction inside the heat-treatment chamber 7. In other words, the flameproofing is performed, within one flameproofing furnace 2, at several levels (multiple levels) for continuous carbon fiber precursor fiber bundles 1.

In addition, flameproofing by applying hot air is generally performed for 30 to 100 minutes with the intensity of hot air of 0.5 to 4.5 m/s in terms of air speed.

With regard to the hot air which is blown from the heat-treatment chamber to the sealing chamber, it is necessary for the space velocity SV (1/h) of the hot air, which is the value obtained by dividing the flow rate of hot air ($Nm^3/h$) by the volume ($m^3$) of the sealing chamber, to satisfy the relationship which is represented by the following formula:

$$80 \leq SV \leq 400$$

The space velocity SV indicates the turn-over number of the volume in the sealing chamber per hour by the hot air blown from the heat-treatment chamber to the sealing chamber. In order to determine the space velocity SV, the flow speed measured by installing, for example, a hot wire anemometer on slit part is used. In this embodiment, each of the flow speed of the hot air blowing from the heat-treatment chamber 7 to the sealing chamber 8 via each of inner slits 6 is measured by using a hot wire anemometer, and by multiplying the measured flow speed by the opening area of the corresponding slit 6, the flow rate of hot air ($Nm^3/h$) is obtained as the sum of the products. Furthermore, by dividing the flow rate by the total volume of the sealing chamber 8, SV (1/h) is obtained. As the space velocity SV increases, retention time of the volatile substances in the sealing chamber tends to decrease. If consideration is made only from the viewpoint of preventing aggregation of volatile substances, it may be easily believed that the higher space velocity SV is preferred, but it is not true in real cases. Namely, the inventors of the present invention found that, when the hot air blown from the heat-treatment chamber to a sealing chamber is simply increased, there is a case in which the aggregation of volatile substances increases on the contrary. Furthermore, as a result of intensive studies by the inventors of the present invention, it was found that, by having the space velocity SV in the range of this embodiment, a carbon fiber with high quality can be obtained.

In order to have a high space velocity SV, size of the sealing chamber (internal volume) may be reduced or the amount of hot air which is blown from the heat-treatment chamber to the sealing chamber may be increased. However, the size of the sealing chamber is limited in terms of facilities. Namely, unlimited enlargement or reduction of the sealing chamber is neither possible nor reasonable.

As such, the space velocity SV is adjusted within the range of $80 \leq SV \leq 400$ by having a reasonable size of the sealing chamber which is determined from the viewpoint of ordinary facilities, that is, 20 to 40% of the heat-treatment chamber, and by adjusting the air amount of hot air which is blown from the heat-treatment chamber to the sealing chamber.

Meanwhile, the air amount of hot air which is blown from the heat-treatment chamber to the sealing chamber can be adjusted by controlling pressure difference between the heat-treatment chamber and the sealing chamber. The adjustment of the pressure difference can be achieved by the following means. 1) Air discharge amount from the sealing chamber is controlled, 2) independent of the air discharge from the sealing chamber, air is supplied and/or discharged to and/or from the heat-treatment chamber and the amount of the supplied and/or discharged air is controlled. Needless to say, both of the above 1) and 2) can be performed simultaneously. The air discharge amount from the sealing chamber 8 can be adjusted by controlling air discharge using the discharge means 9. The supply of the air to and/or discharge of the air from the heat-treatment chamber 7 is carried out by a ventilation means installed on the heat-treatment chamber 7.

By having $SV>400$, the amount of volatile substances that are discharged from the heat-treatment chamber to the sealing chamber increases. Accordingly, the amount of the volatile substances which aggregate in the sealing chamber increases. As such, the strength of the carbon fiber produced in such a condition is lower compared to the preferable level.

On the other hand, by having $SV<80$, the gas retention time in the sealing chamber tends to increase. Accordingly, even though the amount of the volatiles substances that are discharged from the heat-treatment chamber to the sealing chamber decreases, there is a tendency that the volatile substances aggregate more in the sealing chamber. As a result, the strength of the produced carbon fiber is lower compared to the preferable level.

The space velocity SV is preferably $180 \leq SV \leq 400$. More preferably, it is in the range of $200 \leq SV \leq 400$, and even more preferably in the range of $250 \leq SV \leq 375$. Furthermore, when it is in the range of $300 \leq SV \leq 350$, a carbon fiber with even higher quality is obtained, and therefore particularly preferable.

The flameproofing is performed while transporting the carbon fiber precursor fiber bundles through the inside of a flameproofing furnace. The transporting conditions include adjustment of an introduction amount (introduction rate) of the carbon fiber precursor fiber bundle to a flameproofing furnace and an amount of the hot air. When the introduction amount of a carbon fiber precursor fiber bundle into the flameproofing furnace (introduction amount per hour) is designated as Y (kg/h) and the total air discharge amount from the heat-treatment chamber is designated as X ($Nm^3/h$), it is preferable that the following relationship is satisfied:

$$0.001 \leq Y/X \leq 0.012$$

The total air discharge amount X can be obtained by adding the hot air amount measured at each inner slit 6 and, if the aforementioned ventilating means is installed on the heat-treatment chamber 7, air discharge amount through the ventilating means measured by using the measurement device installed on the ventilating means (not illustrated). As for the measuring device, the same kind of measuring device as used for determining the space velocity SV can be used.

The aforementioned Y/X is a value which is used as a reference of the concentration of volatile substances that are present in the heat-treatment chamber. Solely from the point of view of preventing the aggregation of the volatile substances, it seems to be preferable to have this value as low as possible, but actually not. Namely, when the total air discharge amount X from the heat-treatment chamber is simply increased, there is a case in which the total amount of volatile substances that are introduced to the sealing chamber increases on the contrary.

As such, Y/X is preferably in the range of $0.001 \leq Y/X \leq 0.012$. When it is in the range of $0.01 \leq Y/X \leq 0.05$, a carbon fiber with even higher quality can be obtained and also the production efficiency can be improved, and therefore preferable. More preferably, it is in the range of $0.01 \leq Y/X \leq 0.02$.

According to the flameproofing of this embodiment, control of the space velocity SV can be achieved by, as described above, controlling the air amount of hot air which is blown from the heat-treatment chamber to a sealing chamber. Control of the air amount can be performed by modifying treatment conditions such as air discharge amount using a ventilation means (discharge fan) or temperature conditions for heat treatment using a heating means, as described above. However, it is also possible to control them to some extent based on design of the size of each of the sealing chambers, outer slits, and inner slits. At that time, by controlling the space velocity SV, the flow amount of air introduced to the sealing chamber can be reduced, and also the air amount of the hot air which is blown from heat-treatment chamber to a sealing chamber can be reduced. This can be achieved by controlling the pressure of the sealing chamber according to the method described below.

In order to reduce the flow amount of hot air, it is common to reduce the opening of hot air flow path. However, for the manufacture of a carbon fiber, when the opening of a slit of a flameproofing furnace is simply reduced, the following problems intrinsic to a carbon fiber can occur.

Generally, the difference in pressure between inside of a flameproofing furnace and outside of the furnace changes in the direction of furnace height, due to the buoyancy between the inside and outside of the heat-treatment chamber, which is caused by the difference in gas temperature. In other words, in the top part of a furnace, the pressure difference is large between the inside and outside of the furnace. In the bottom part of the furnace, the pressure difference is small between the inside and outside of the furnace.

Namely, the hot air containing volatile substances, in the top part of a furnace, discharged from the heat-treatment chamber to a sealing chamber. On the other hand, in the bottom part of a furnace, the external air is introduced from the outside of a furnace to a sealing chamber and also introduced from the sealing chamber to the heat-treatment chamber. Due to the introduced external air, a reduction in temperature within the heat-treatment chamber or sealing chamber is caused. Thus, the volatile substances can aggregate more in the top part of a flameproofing furnace, and they hardly aggregate in the bottom part of a flameproofing furnace. Accordingly, when the opening area of a slit is uniformly reduced, a significant aggregation of volatile substances occurs particularly at slits in the top part of the flameproofing furnace.

In order to solve this problem, in this embodiment, each slit is formed at plural points at different positions in the up and down direction (vertical direction) in the heat-treatment chamber, and the transport of the carbon fiber precursor fiber bundle is made based on horizontal transport in the heat-treatment chamber, and, regarding the plural outer slits, the opening of the outer slit present at the lowermost side is prepared to be smaller than the opening of the outer slit present at the uppermost side. Specifically, the opening of the outer slit present at the lowermost side is preferably 1/100 to 1/2 of the opening of the outer slit present at the uppermost side. More preferably, it is 1/6 to 1/3. In this embodiment, the opening of slit can be modified as the width of each slit, namely the size in the up and down direction shown in the drawing are adjustable.

Furthermore, with regard to the inner slit, the opening of the inner slit present at the lowermost side in the vertical direction can be prepared to be smaller than the opening of the inner slit present at the uppermost side, like the outer slit described above. With regard to the preferable ratio of the openings of inner slits in the up and down direction, the same holds true as the outer slits described above.

By adopting the configuration as described above, the flow amount of air introduced to a sealing chamber can be more conveniently reduced, and also the air amount of hot air which is blown from the heat-treatment chamber to a sealing chamber can be reduced.

(Carbonization Treatment)

According to the method for manufacturing a carbon fiber of this embodiment, a flameproofed carbon fiber bundle obtained by flameproofing of a carbon fiber precursor fiber bundle is introduced into a carbonization furnace, and subjected to carbonization treatment in a temperature range of 300° C. to 2500° C. to obtain a carbon fiber. The carbonization treatment indicates a treatment for carbonizing a flameproofed fiber bundle at the above temperature in an inert gas. The carbonization indicates removal of other elements from a compound, in particular, making an organic compound into a state in which 80 to 100% of the weight of the compound consists of carbon atoms by removing hydrogen and oxygen at the temperature mentioned above. Inert gas means a chemically stable gas which does not cause a reaction with other substance, and specific examples thereof include nitrogen, helium, and argon. The reaction may be performed while forming a temperature gradient, or alternatively, a treatment with plural temperature steps may be performed. The carbonization according to this embodiment is preferably performed, particularly at conditions of 1200 to 1800° C., for 1 to 4 minutes in total. Other conditions for the carbonization, for example, the carbonization conditions described in the aforementioned patent documents or the like, may be suitably adjusted depending on the property of a carbon fiber to be obtained, in view of the technical knowledge known to a person skilled in the pertinent art.

Other Embodiments

According to the example shown in FIG. 1, the number of a single set (level number) consisting of the outer slit 5 and the inner slit 6, which are provided horizontally on the lateral side of the flameproofing furnace 2, is 5 (5 sets). However, it can be a number less than 5 or a number more than 5, depending on the scale of the flameproofing furnace 2. As usual, it can be 2 to 12 sets or so.

EXAMPLES

Hereinbelow, the effect of the present invention is described in more detail in view of examples. Meanwhile, each example and comparative example was carried out by using a flameproofing furnace which has a heat-treatment chamber and a sealing chamber adjacent thereto. In the heat-treatment chamber, the carbon fiber precursor fiber bundle is transported in the horizontal direction at five levels in height. The sealing chamber has outer slits and inner slits of the same number as the number of levels for transporting the carbon fiber precursor fiber bundle. The outer slit is open on the outside of the flameproofing furnace, and the inner slit is open on the heat-treatment chamber. The volume of the sealing chamber is 2.73 $m^3$.

Each measurement value was obtained according to the following method.

<Strand Strength of Carbon Fiber Bundle>

On the basis of the JIS R7601 test method, measurement was made for 35 test strand specimens, and the average value was obtained.

<Amount of Hot Air Suctioned from/Blown into Sealing Chamber>

By using a smoke tester, air flow at each slit part was detected. The slit showing an air flow from the sealing chamber to the heat-treatment chamber was designated as suctioning part, and the slit showing an air flow from the heat-treatment chamber to the sealing chamber was designated as blow-out part. Furthermore, by using a hot wire anemometer (Anemomaster 6162 manufactured by KANOMAX JAPAN INC.), the flow speed (m/h) at the blow-out part was measured, and by multiplying the flow speed with the opening area, flow rate ($Nm^3/h$) of the hot air was obtained. Furthermore, the total flow rate of the hot air measured at each slit of the blow-out part (total air discharge amount X) was divided by the volume of a sealing chamber, and the result was used as space velocity SV (1/h).

Example 1

A polymer containing 98% by mass of an acrylonitrile unit and 2% by mass of a methacrylic acid unit was dissolved in dimethylformamide to obtain a spinning dope (polymer concentration: 23.5% by mass). By dry jet-wet spinning, the spinning dope was discharged from a spinneret having 2000 spouting holes with a diameter of 0.13 mm, first passed through a space of about 4 mm, and then solidified in a solidification solution, which is an aqueous solution containing 79.5% by mass of dimethylformamide adjusted to 15° C., to yield a solidified fiber. Subsequently, the solidified fiber was elongated by 1.1 times in air, and then, in an aqueous solution containing 30% by mass of dimethylformamide adjusted to 60° C., further elongated by 2.9 times. After the elongation, the fiber bundle containing the solvent was washed with clean water, and then elongated by 1.1 times in hot water at 95° C. Subsequently, the fiber bundle was dried to obtain a fiber bundle which consists of 12000 filaments having single fiber fineness of 0.8 deier.

Subsequently, the following oiling agent was applied to the above fiber bundle before drying and densification. The adhesion amount of the oiling agent was 1.1% by mass relative to the fiber bundle mass after the drying and densification. The fiber bundle obtained after the drying and densification was elongated by 3.0 times between heating rolls for having an additional improvement of orientation and densification followed by winding-up to obtain a carbon fiber precursor fiber bundle. The fineness of the carbon fiber precursor fiber was 0.77 dtex.

<Oiling Agent>

The following (1) amino-modified silicone oil and (2) an emulsifying agent were admixed with each other, and by a reverse phase emulsification, an aqueous dispersion (water-based fiber emulsion) was prepared.

(1) Amino-modified silicone oil: KF-865 (manufactured by Shin-Etsu Chemical Co., Ltd., first grade side-change type, viscosity: 110 cSt (25° C.), amino equivalent: 5000 g/mol, 85% by mass (2) Emulsifying agent: NIKKOL BL-9EX (manufactured by Nikko Chemicals Co., Ltd., POE (9) lauryl ether) 15% by mass The above carbon fiber precursor was subjected to flameproofing by using a flameproofing furnace. The circulating air in the heat-treatment chamber of the flameproofing furnace was set to have air flow speed of 3.0 mm/s, from the center to the two lateral sides of the furnace. The vertical distance between adjacent sheets which are transported through the heat-treatment chamber in the horizontal direction at 5 levels of was 200 mm. The slit width of the sealing chamber was 350 mm and the heights of the outer and inner slits were as follows; for the top three levels, the height was 30 mm, and for the bottom two levels, the height was 10 mm. Three furnaces were used, and the time for flameproofing was 60 minutes in total. The temperature for flameproofing was 220 to 280° C.

Next, the carbon fiber precursor fiber bundle obtained after flameproofing was introduced into the first carbonizing furnace having a temperature gradient of 300 to 700° C. in nitrogen, while having an elongation of 4.5%. The temperature was set to be linear slope. The treatment time was 1.9 minutes.

Furthermore, the carbon fiber precursor fiber bundle obtained through the first carbonizing furnace was introduced into the second carbonizing furnace having a temperature gradient of 1000 to 1250° C. in nitrogen, while having an elongation of −3.8%. Next, it was introduced into the third carbonizing furnace having a temperature gradient of 1250 to 1500° C. in nitrogen, while having an elongation of −0.1% to obtain a carbonized fiber bundle. The total elongation rate through the second carbonization furnace and the third carbonization furnace was −3.9%, and the treatment time was 3.7 minutes.

Subsequently, the carbonized fiber bundle was subjected to an electric treatment between the carbon fiber bundle as a positive electrode and an opposite electrode at an electricity of 40 coulomb per 1 g of the carbon fiber while running through a 10% by mass aqueous solution of ammonium bicarbonate. It was then washed in hot water at 90° C. followed by drying. Next, it was applied with 0.5% by mass of a urethane resin (product name of HYDRAN N320, manufactured by DIC Corporation), and wound-up on a bobbin, thus a carbon fiber bundle was obtained.

The total air discharge amount X ($Nm^3/h$) from the heat-treatment chamber, the introduction amount Y (kg/h) of the carbon fiber precursor fiber bundle to the flameproofing furnace, Y/X, strand strength of carbon fiber (MPa), and space velocity SV of hot air (1/h) for the above steps were presented in Table 1.

The circulating air in the heat-treatment chamber of the flameproofing furnace was set to have air flow speed of 3.0 mm/s, from the center to the two lateral sides of the furnace. The vertical distance between adjacent sheets which are transported through the heat-treatment chamber in the horizontal direction at 5 levels was 200 mm. The slit width of the sealing chamber was 350 mm and the heights of the outer slits were as follows; for the top three levels, the height was 30 mm, and for the bottom two levels, the height was 10 mm. Three furnaces were used, and the time for flameproofing was 60 minutes in total. The temperature for flameproofing was 220 to 280° C.

The total air discharge amount X ($Nm^3/h$) from the heat-treatment chamber, the introduction amount Y (kg/h) of the carbon fiber precursor fiber bundle to the flameproofing furnace, Y/X, strand strength of carbon fiber (MPa), and space velocity SV of hot air (1/h) were presented in Table 1.

Examples 2 and 3

Manufacture of a carbon fiber was performed at the same conditions as Example 1 except that the introduction amount Y of the carbon fiber precursor fiber bundle to the flameproofing furnace was modified. The results were presented in Table 1.

Example 4

Manufacture of a carbon fiber was performed at the same conditions as Example 1 except that the height of the outer and inner slits in the bottom two levels was modified to 5 mm. The results were presented in Table 1.

Comparative Example 1

At the same conditions as Example 2, the heights of the all outer and inner slits were adjusted to 30 mm. As a result, the external air introduced from the outer slit to the sealing chamber was increased, and also the flow speed of the hot air blown from the heat-treatment chamber to the sealing chamber was increased. Accordingly, the total air discharge amount X from the heat-treatment chamber and the space velocity SV of the hot air were increased. The results were presented in Table 1. Meanwhile, when measured at the same conditions as other test, the strand strength was found to be 6627 M Pa.

Comparative Example 2

At the same conditions as Example 1, as a result of performing discharge at 2000 $Nm^3/h$ by using a discharge line formed in a circulating air line, the hot air blown from the heat-treatment chamber to the sealing chamber disappeared. The results were presented in Table 1.

TABLE 1

| | | Example 1 | Example 2 | Example 3 | Example 4 | Comparative Example 1 | Comparative Example 2 |
|---|---|---|---|---|---|---|---|
| Total air discharge amount X | $Nm^3/h$ | 900 | 900 | 900 | 500 | 1300 | 2000 |
| Introduction amount Y of carbon fiber precursor fiber bundle | kg/h | 3.47 | 6.94 | 1.94 | 3.47 | 6.94 | 6.94 |
| Y/X | $kg/Nm^3$ | 0.004 | 0.008 | 0.002 | 0.007 | 0.005 | 0.003 |
| Strand strength | MPa | 6765 | 6706 | 6833 | 6814 | 6629 | 6529 |
| Space velocity SV | l/h | 330 | 330 | 330 | 183 | 476 | 0 |

From the above Examples and Comparative Examples, it was found that a carbon fiber with high strand strength can be obtained by the method for manufacturing a carbon fiber of the present invention.

INDUSTRIAL APPLICABILITY

According to the method for manufacturing a carbon fiber of the present invention, a carbon fiber with high strength and high quality can be obtained.

EXPLANATIONS OF LETTERS OR NUMERALS

1 CARBON FIBER PRECURSOR FIBER BUNDLE
2 FLAMEPROOFING FURNACE
3*a* to 3*c*, 4*a* to 4*c* TRANSPORTING MEANS
5, 51*a*, 51*c*, 52*a*, 52*c* OUTER SLIT
6, 61*a*, 61*c*, 62*a*, 62*c* INNER SLIT
7 HEAT-TREATMENT CHAMBER
8, 8A, 8B SEALING CHAMBER
9 MEANS FOR AIR DISCHARGE

The invention claimed is:

1. A method for manufacturing a carbon fiber, the method comprising:

introducing carbon fiber precursor fiber bundles that have been spread in sheet form into a flameproofing furnace;

flameproofing the carbon fiber precursor fiber bundles introduced into the flameproofing furnace at a temperature of from 200° C. to 300° C.;

introducing the flameproofed fiber bundles obtained from the flameproofing treatment into a carbonization furnace; and carbonizing the flameproofed fiber bundles introduced into the carbonization furnace at a temperature of from 300° C. to 2500° C.;

wherein the flameproofing furnace comprises a heat-treatment chamber and a sealing chamber adjacent thereto and discharges air from the sealing chamber to outside of the flameproofing furnace; and wherein space velocity (SV) (1/h) of the hot air blown from the heat-treatment chamber into the sealing chamber satisfies the following relationship: $80 \leq SV \leq 400$.

2. The method for manufacturing a carbon fiber according to claim 1, wherein, when an introduction amount of the carbon fiber precursor fiber bundles into the flameproofing furnace is designated as Y (kg/h) and a total air discharge amount from the heat-treatment chamber to the outside of the heat-treatment chamber is designated as X ($Nm^3/h$), a ratio of Y/X satisfies the following relationship: $0.001 \leq Y/X \leq 0.012$.

3. The method for manufacturing a carbon fiber according to claim 1, wherein:

the flameproofing is performed by transporting the carbon fiber precursor fiber bundles, in the fiber direction of the carbon fiber precursor fiber bundles, through the inside of the heat-treatment chamber, in which the transport is made such that the carbon fiber precursor fiber bundles are transported in parallel relationship at plural points inside the heat-treatment chamber; and the sealing chamber comprises outer slits open on an outer side of the flameproofing furnace and inner slits open on the heat-treatment chamber, wherein the number of the outer slits and the number of the inner slits are the same as the number of times the carbon fiber precursor fiber bundles are transported.

4. The method for manufacturing a carbon fiber according to claim 3, wherein:

the flameproofing is performed such that the transport is made in the horizontal direction in the heat-treatment chamber while plural points indicate plural points at vertically different positions in the heat-treatment chamber; and each of the plural outer slits is formed at vertically different positions and an opening area of the outer slit present at a lowermost side in the vertical direction is smaller than an opening area of the outer slit present at an uppermost side.

5. The method for manufacturing a carbon fiber according to claim 2, wherein:

the flameproofing is performed by transporting the carbon fiber precursor fiber bundles, in the fiber direction of the carbon fiber precursor fiber bundles, through the inside of the heat-treatment chamber, in which the transport is made such that the carbon fiber precursor fiber bundles are transported in parallel relationship at plural points inside the heat-treatment chamber; and the sealing chamber comprises outer slits open on an outer side of the flameproofing furnace and inner slits open on the heat-treatment chamber, wherein the number of the outer slits and the number of the inner slits are the same as the number of times the carbon fiber precursor fiber bundles are transported.

6. The method for manufacturing a carbon fiber according to claim 5, wherein:

the flameproofing is performed such that the transport is made in the horizontal direction in the heat-treatment chamber while plural points indicate plural points at vertically different positions in the heat-treatment chamber; and each of the plural outer slits is formed at vertically different positions and an opening area of the outer slit present at a lowermost side in the vertical direction is smaller than an opening area of the outer slit present at an uppermost side.

* * * * *